US005380210A

United States Patent [19]

Grabbe et al.

[11] Patent Number: 5,380,210

[45] Date of Patent: Jan. 10, 1995

[54] HIGH DENSITY AREA ARRAY MODULAR CONNECTOR

[75] Inventors: Dimitry Grabbe, Middletown; Iosif Korsunsky, Harrisburg; Michael F. Laub, Etters, all of Pa.

[73] Assignee: The Whitaker Corporation, Wilmington, Del.

[21] Appl. No.: 218,863

[22] Filed: Mar. 28, 1994

Related U.S. Application Data

[63] Continuation of Ser. No. 26,911, Mar. 8, 1993, abandoned.

[51] Int. Cl.[6] ..... H01R 23/68

[52] U.S. Cl. ..... 439/66

[58] Field of Search ..... 439/66, 74, 91, 591, 439/862

[56] References Cited

U.S. PATENT DOCUMENTS

| | | | |
|---|---|---|---|
| 4,090,293 | 5/1978 | van der Donk et al. | 439/736 |
| 4,161,346 | 7/1979 | Cherian et al. | 439/66 |
| 4,505,529 | 3/1985 | Barkus | 439/82 |
| 4,511,197 | 4/1985 | Grabbe et al. | 439/69 |
| 4,513,353 | 4/1985 | Bakermans et al. | 361/399 |
| 4,699,593 | 10/1987 | Grabbe et al. | 439/71 |
| 4,752,231 | 6/1988 | Olsson | 439/66 |
| 4,961,709 | 10/1990 | Noschese | 439/66 |
| 4,969,826 | 11/1990 | Grabbe | 439/66 |
| 5,046,967 | 9/1991 | Majernik et al. | 439/931 |
| 5,061,192 | 10/1991 | Chapin et al. | 439/66 |
| 5,098,305 | 3/1992 | Krajewski et al. | 439/75 |
| 5,139,427 | 8/1992 | Boyd et al. | 439/81 |
| 5,167,512 | 12/1992 | Walkup | 439/66 |

FOREIGN PATENT DOCUMENTS

| | | | |
|---|---|---|---|
| 2234961 | 4/1973 | Germany | 439/66 |
| 148878 | 6/1990 | Japan | 439/84 |

*Primary Examiner*—Gary F. Paumen

*Attorney, Agent, or Firm*—Driscoll A. Nina; Bruce J. Wolstoncroft

[57] ABSTRACT

A connector for electrically connecting circuit members having a high density of contact pads located in an area array, the connector having an area array specific holder that is simple to produce for retainably positioning mass-produced standardized contact modules containing a deformable contact within a module body for interconnecting the contact pads, where the contact is constructed to be supportingly engaged by the module body to provide sufficient opposing spring force to effect a wiping interconnection between the contact and the contact pads.

24 Claims, 5 Drawing Sheets

13
12
10
18
16
46
48
50
52
16
66a
68
44
20
48'
46'
50'
52'
20
16a
16a
14

HIGH DENSITY AREA ARRAY MODULAR CONNECTOR

This application is a Continuation of application Ser. No. 08/026,911 filed Mar. 8, 1993, now abandoned.

FIELD OF THE INVENTION

This invention relates to electrical connectors and more specifically to z-axis compressible connectors used for interconnecting electrical circuit members such as, integrated circuit chips, multi-chip substrates and printed circuit boards, having a high density of electrical contact pads arranged in an area array, and especially such connectors that are adapted for very high frequency requirements.

BACKGROUND OF THE INVENTION

The integrated circuits being used in modern electronic devices, such as computers, are essentially substrates that function like miniature printed circuit boards. Contact pads are deposited on the chips. In order to minimize signal propagation delay and to preserve circuit member real estate, the connection between mating components must be accomplished over as small a path as possible. Therefore, as chip technology advances and the chips increase in size and capability, there is a need for connectors capable of interconnecting the associated high density contact patterns, typically referred to as an area array some of which may have up to 11,500 positions, on a grid as small as one (1.0) millimeter.

A variety of methods have been used to establish the electrical connection. One of these is the interposer-type connector. In this type of connector, it is typical for the electrical connection to occur across spring member contacts contained within a housing. The connector is sandwiched between the mating components. Examples of various interposer-type connectors, and their contacts, are disclosed in U.S. Pat. Nos. 4,969,826 and 5,139,427, assigned to the assignee of the present invention, and U.S. Pat. No. 5,061,192. In the '826 patent a plurality of contact modules, shown with a shunting contact within a two-piece plastic body, are contained within openings in a holder. The '427 patent discloses a connector having contacts positioned between two plastic sheets which are laminated together to make up the body and hold the contacts in place. The '192 patent discloses a connector having a plurality of resilient contact members held in a suspended and spaced orientation by elongated members spanning an opening in a frame.

What is still needed is a connector capable of high density interconnections (1 millimeter or larger grids) that is economical to manufacture, in small lots and in various configurations, having contacts requiring low compressive forces while still insuring reliable and repeatable interconnections with mating circuit members.

SUMMARY OF THE INVENTION

The present invention is a connector, contact and contact module for electrically connecting circuit members such as, integrated circuit packages, multi-chip substrates and printed circuit boards having a high density of contact pads. The connector utilizes a plurality of standard connector modules. Each contact module has a module body with a first end, a second end and a tubular passageway extending therethrough and, received within the passageway, is a contact having a first contact section extending outward from the first end of the body and a second contact section extending outward from the second end of the body. The contact sections are connected by a resilient portion constructed to oppose movement of the contact sections toward each other and, upon displacement of the contact sections towards each other, the resilient portion comes into supporting engagement with the module body along a portion of the passageway. These standard contact modules are inserted into openings in a holder that are spaced to correspond to the contact pads on the circuit members that are to be interconnected. When the circuit members are compressed against the contact sections, the resilient portion supportingly engages the module body and further displacement of the contact sections causes a wiping interconnection between the contacts and the contact pads.

It is an object of this invention to provide a high density electrical connector that utilizes contacts having a low compression force requirement to establish a reliable and repeatable electrical connection between a high density of contact pads on mating circuit members. It is another object of this invention to provide an electrical connector that is easily and economically manufactured to various contact pad spacings.

It is a feature of this invention that deformation of the contact is limited by the body and, upon compression of the contact surfaces, the contact comes into supporting engagement with the body along the passageway enabling a wiping connection to be made. It is another feature of this invention that the effects of compression of one of the contact surfaces may be independent of compression of the other contact surface.

It is an advantage of this invention that the contact is captivated within the module body creating a contact module that can be handled as a single piece. It is another advantage of this invention that various configurations of the connector can be produced economically through flexible manufacturing techniques consisting primarily of software changes. It is a further advantage of this invention that the holder may be made of metal for minimizing cross-talk between adjacent contacts, a dielectric that may be selectively metalized or a hard or flexible multi-layered printed circuit board for selectively interconnecting various contacts.

DESCRIPTION OF THE INVENTION

Figure 1:
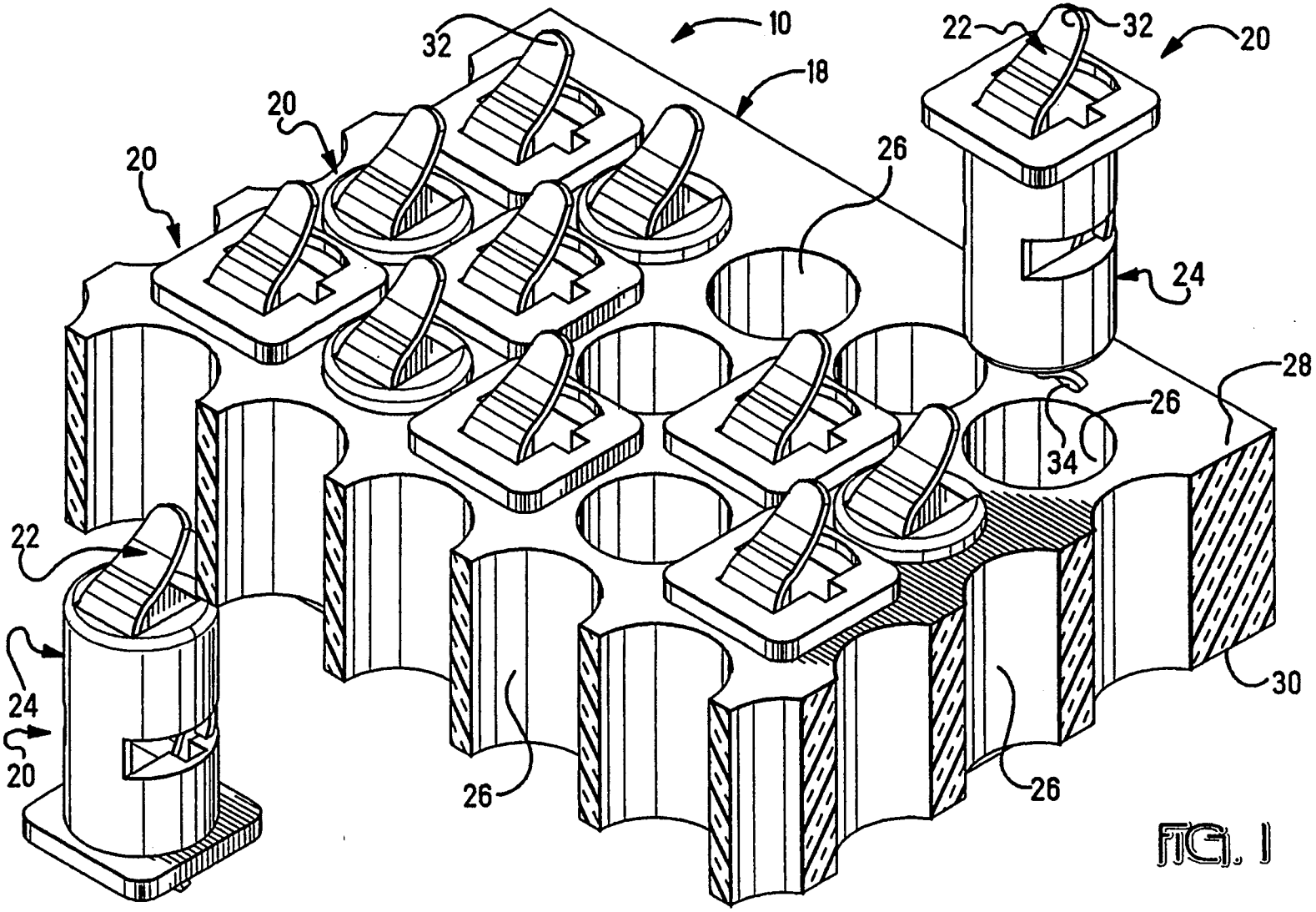
FIG. 1 is a partially exploded upper perspective view of a portion of the connector.
Figure 2:
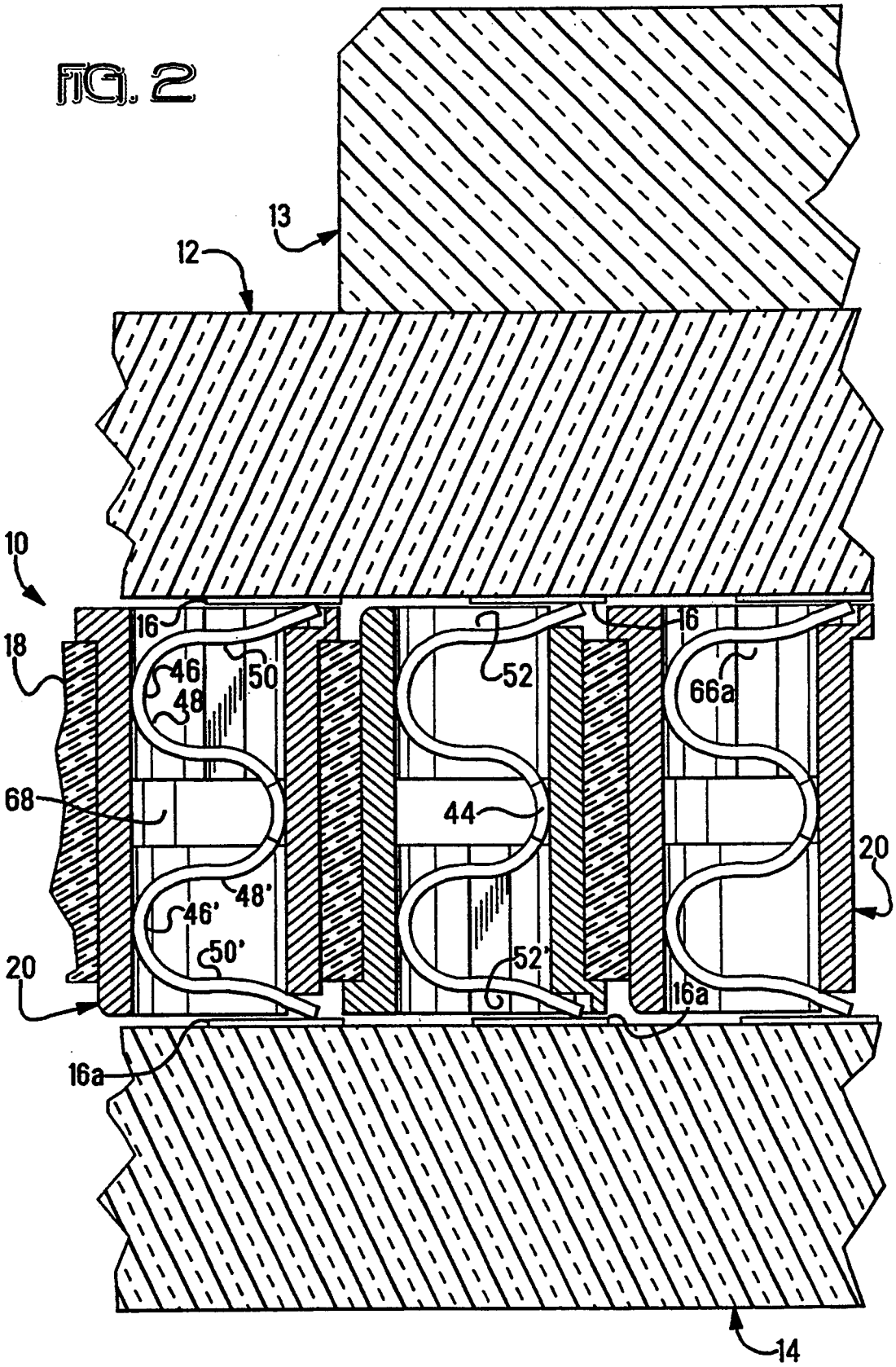
FIG. 2 is a cut-away view of a portion of the connector between the mating substrates.

FIG. 1 shows a partial view of the connector 10 of the present invention. FIG. 2 shows the connector 10 between a first circuit member 12 having a circuit component 13 and a second circuit member 14. The circuit members may be integrated circuit chips, multi-chip substrates or printed circuit boards, which include multilayered circuit structure including one or more conductive layers. The first and second circuit members 12,14 have contact pads 16,16*a* respectively which are to be interconnected by the connector.

The connector 10 includes a holder 18 for positioning and retaining a plurality of contact modules 20. Each contact module 20 has a resilient contact 22 contained within a module body 24. These contact modules 20 fit within the openings 26 that extend between the first major surface 28 and the second major surface 30 of the holder 18. The openings 26 are spaced so that they correspond to at least the contact pads 16,16*a* on the first and second circuit members 12,14.

Each resilient contact 22 has a first contact section 32 for engaging the contact pads 16 of the first circuit member 12 and a second contact section 34 for engaging the contact pads 16a of the second circuit member 14. A substantially curvilinear resilient portion 36 of varying width interconnects the contact sections 32,34 and is formed to oppose movement of the contact sections 32,34 towards each other. The resilient portion 36 has a first deformed member 38 that includes the first contact section 32, a second deformed member 40 that includes the second contact section 34, and a midpoint 42 where the first and second deformed members 38,40 merge together. The midpoint 42 is also the point about which the deformed members 38,40 are mirror images of each other. An advantage of the mirror image construction is that the spring forces being exerted in opposite directions by the contact are essentially equal.

Figure 3:
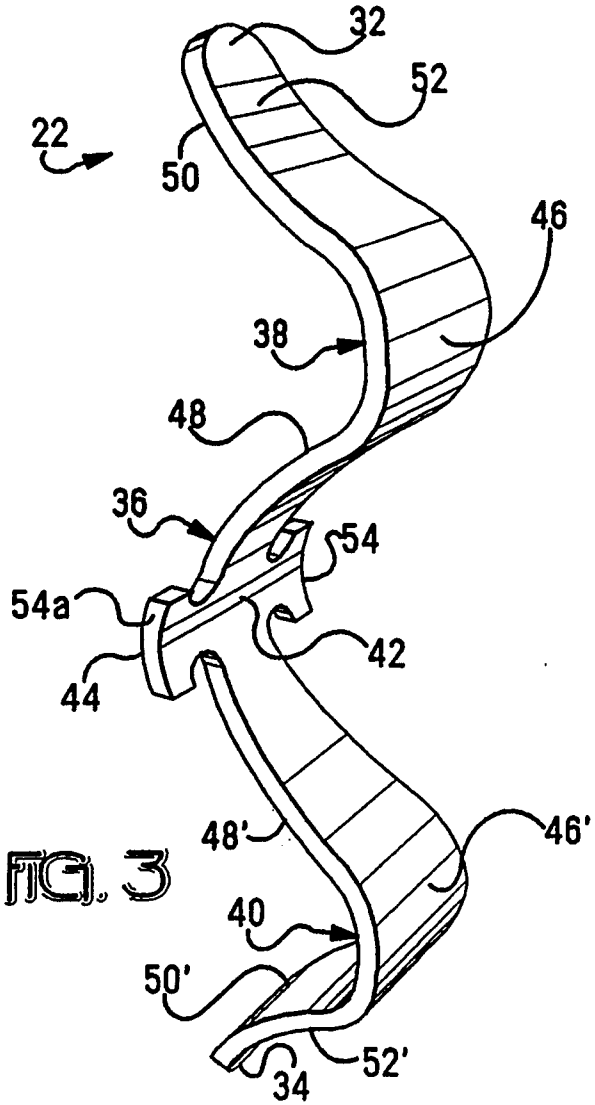
FIG. 3 is a perspective view of the contact.

In the bow-shaped unitary contact 22 of FIG. 3, which is constructed in a mirror image about the midpoint 42, the contact 22 is formed with a central radius 44 symmetrical about the midpoint 42 with half of the central radius 44 included in the first deformed member 38 and the other half in the second deformed member 40. A primary radius section 46,46', facing in the opposite direction of the central radius 44 and located outward from the midpoint 42, is included in each deformed member 38,40 respectively. Extending along the deformed members 38,40 from the central radius 44 to the primary radius sections 46,46' are interior radius sections 48,48' respectively. An outward radius section 50,50' having a concave section 52,52' facing away from the midpoint 42 extends from the primary radius sections 46,46' to the respective contact sections 32,34, thereby completing each deformed member 38,40.

The contact 22 has first and second opposing sides 47,49. The primary radius sections 46,46' are convex with respect to the first side 47 and open with respect to the second side 49. The central radius section 44 is convex with respect to the second side 49 and open with respect to first side 47, thereby defining a contact 22 with primary radius sections 46,46' that face opposite the central radius section 44.

Another advantage of forming the contact 22 in a mirror image about a central point is that the self-inductance created as a signal passes through the contact 22 can be minimized. The primary radius sections 46,46' faces opposite the central radius 44 and the interior radius sections 48,48' could be formed as opposites to their respective outward radius sections 50,50'. By forming the contact so that the signal will reverse direction, this configuration serves to cancel a significant amount of the self-inductance induced by the current flow through the contact 22.

Figure 4:
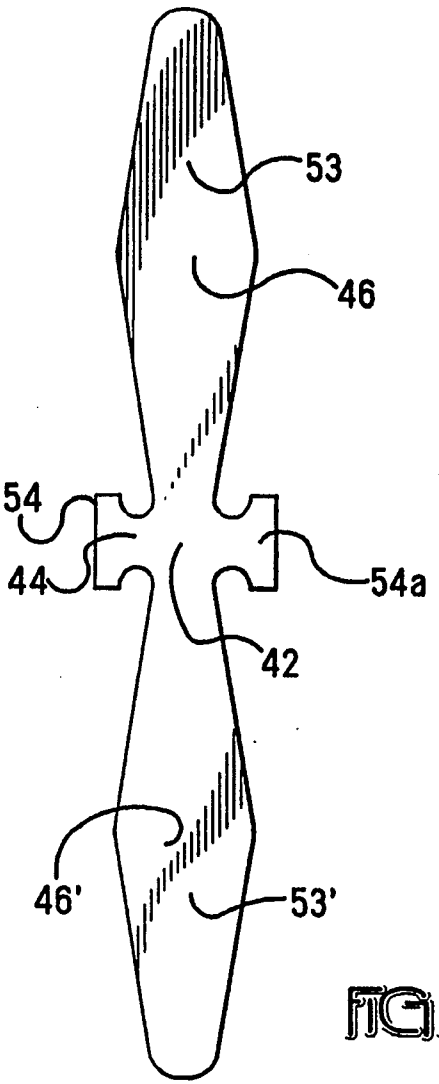
FIG. 4 is a front view of the contact.

The width profile must be such that the contact 22 will exert the required amount of force to assure that a reliable and repeatable electrical interconnection is achieved and the interconnection will be maintained through the life of the connector. As seen in FIG. 4, the width of the contact is formed in two opposing arrowhead shaped sections 53,53', symmetrical about the midpoint 42 and of a greater width corresponding to the central radius and the two primary radius sections. The contact 22 is optimized so that mechanical stresses are uniformly distributed throughout the contact 22 to prevent local creep that would have a detrimental effect on the integrity of the interconnection. The physical characteristics of the material determine the width profile of the contact 22. In one of the versions of the invention, at the midpoint 42, protrusions 54,54*a* extend outward from the contact 22. These protrusions 54,54*a* retain the contact 22 within the module body 24 and localize the further deformation of the contact 22 due to compression of the contact sections 32,34 to their respective deformed members 38,40. These functions are discussed below.

Preferably, the contact 22 is a unitary member that is formed from a monolithic alloy, typically of a noble metal, rather than an electroplated structure, due to superior electrical and mechanical properties. As an example, one acceptable material being PALINEY 7, a palladium-gold alloy sold by J. M. NEY Company of Bloomfield, Conn. The contact illustrated in FIG. 3 is 0.0017 inches thick and formed by stamping from flat stock. Other materials that have the desired electrical conductance and mechanical spring characteristics may also be used. For example, another suitable material is ORO-28A manufactured by the same supplier as referenced above.

Figure 5:
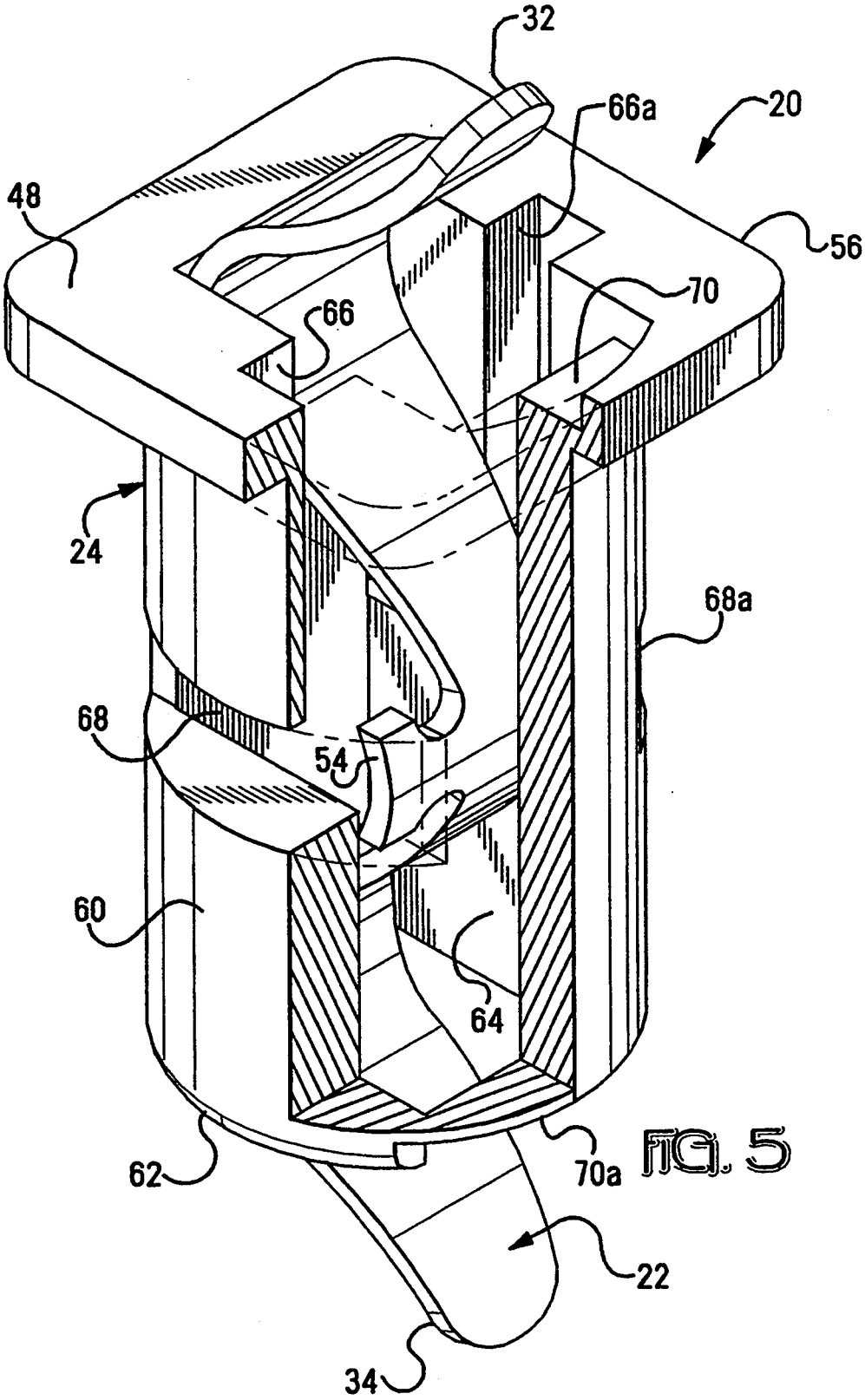
FIG. 5 is an upper perspective, partially cut-away view of the contact module.
Figure 6:
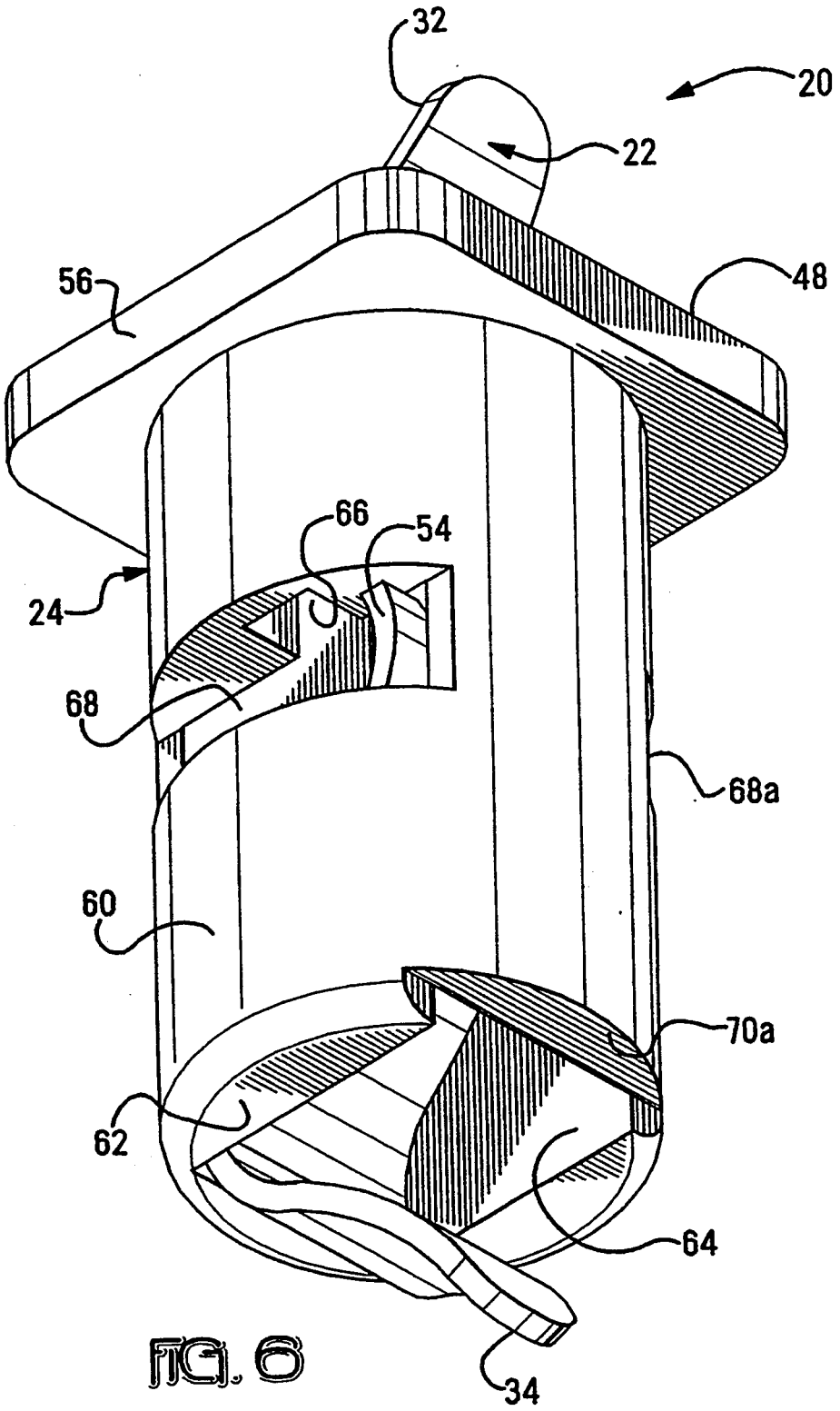
FIG. 6 is a lower perspective view of the contact module.

As seen in FIGS. 4–6, the module body 24 has a rectangular flange 56 extending from a first end 48 to a cylindrical outer section 60 that extends to a second end 62. The shapes of the outer section 62 and the flange 56 are not meant to be limiting and may have other shapes. The outer section 62 fits within the opening 26 of the holder 18. The module body 24 may be made from dielectric or conductive material and would most likely be a molded from a high-temperature thermoplastic material that could be made selectively conductive by metalizing, if desired.

A tubular passageway 64 extends through the module body 24 from the first end 58 to the second end 62. The tubular passageway 64 is constructed for receiving the contact 22. Opposing open channels 66,66*a* extend along the passageway 64 from the first end 58 towards the second end 60 until they intersect opposing lateral cavities 68,68*a*.

The contact 22 is received within the module body 24 by inserting one of the contact sections 32,34 into the passageway 64 from the first end 58. The contact 22 is then biased so that the protrusions 54,54*a* align with the opposing channels 66,66*a* as the contact is fed into the passageway 64. When the protrusions 54,54*a* reach the lateral cavities 68,68*a*, they move laterally within the cavities 68,68*a*, thereby captivating the contact 22 within the module body 24 and creating the contact module 20. It is envisioned that the contact module 20 will be a standardized component used in various connector configurations enabling it to be produced in large quantities allowing for the economies of scale associated with mass production techniques to be recognized.

Once the contact module 20 is assembled, the first and second contact sections 32,34 extend from the ends 58,62 of the module body 24. The deformed members 38,40, which include contact sections 32,34, are formed to provide a wiping-type interconnection with the contact pads 16,16*a* of the circuit members 12,14 as they are compressed against the connector 10. The wipe assures that a reliable interconnection occurs. When the contact sections 32,34 are fully displaced towards each other, as they would be when the connector 10 is in use, each contact section 32,34 is within a seat 70,70*a* located at respective ends 58,62 of the module body 24.

Contacts 22 are designed to provide minimal compressive resistance, less than 50 grams, in order to minimize the total compressive force required to draw the circuit members against the connector. The total compressive force can become quite large in connectors of this type as the number of contacts increases. Each contact section 32,34 may be made independently resistant to compression to assure that the wipe of each contact section/contact pad interconnection is reliable. This is accomplished by the protrusions 54,54*a* being disposed within the lateral cavities 68,68*a*, as described above. As one of the contact sections 32,34 are compressed, the protrusions 54,54*a*, in conjunction with the cavities 68,68*a*, resist the compression independent of whether the opposing contact section 32,34 is being simultaneously compressed. This enables slight dimensional differences of the components to be accommodated without jeopardizing the effectiveness of the interconnections.

In order to create the connector 10, the contact modules 20 are individually placed within openings 26 in the holder 18 and frictionally held therein. In contact modules 20 that incorporate the flange 56, adjacent contacts modules 20 may be inserted into the holder 18 from opposite major surfaces 28,30. The flanges 56 of the plurality of contact modules 20 effectively form a dielectric surface between the holder 18 and each circuit member 12,14.

The first major surface 28 and the second major surface 30 of the holder 18 are spaced apart an amount that has the contact sections 32,34 extending from their respective major surfaces 28,30 when the contact module 20 is placed within the opening 26. The openings 26 of the holder 18 are spaced to correspond to at least the contact pads 16,16*a* of the circuit members 12,14 that are to be interconnected. The openings 26 are cylindrical holes but could be other shapes that correspond to the outer section 60 of the module body 24.

Although the outer section 60 of the module body 24 and the openings 26 through the holder 18 may be formed into shapes other than cylindrical, the cylindrical configuration is the most economically advantageous. Because this is a developing area of technology the volume of production of this type of connector is relatively small; however, the number of different connector configurations, relative the overall volume, is large. This makes the creation of dedicated tooling for each configuration impractical due to the associated high costs.

A cylindrical opening 26 in a holder 18 is easy to produce using conventional and advanced manufacturing techniques. The most common production method would be to drill holes in the holder 18 at the required spacings corresponding to the contact pads 16,16*a* of the circuit members 12,14. Other methods may include Electro-Discharge Machining (EDM) and LASER machining. With the computer controlled machine tools in use today, producing various connector configurations could occur primarily through alterations in the machine tool's software. This makes it possible to economically produce small lots of specialized connectors 10, having various configurations, by manufacturing specific holders 18 and inserting the standard mass produced contact modules 20 into the openings of the holder 18, negating the need for complex and costly dedicated tooling. However, if a volume application were to exist the holder could be produced by molding, die-casting, or powder pressing techniques.

The holder 18 may be made of a dielectric material. Alternatively, in order to reduce cross-talk between contacts 22, the holder 18 may be made from metal to shield the contacts 22 from each other. It is also possible to provide circuitry to the holder 18 for electrically interconnecting various contacts, such as a multi-level circuit board that is either hard or flexible. This would enable contacts to selectively be interconnected for ground, signal and power distributions.

In use, the connector 10 would normally be provided with some type of referencing feature (not shown) for aligning the contacts 22 within the connector 10 with the contact pads 16,16*a* of the circuit members 12,14. When the connector 10 is referenced with the circuit members 12,14 a mechanism (not shown) compresses the circuit members 12,14 against the connector 10.

As the contact pads 16,16*a* of the circuit members 12,14 are compressed against the contact sections 32,34 of the contact 22, the contact 22 is deformed within the passageway 64 of the module body 24. Upon further displacement of the contact sections 32,34 towards each other the central radius 44 and the primary radius sections 46,46' of the resilient portion 36 come into supporting engagement with the module body 24 along the passageway 64. The central radius 44 is prevented from bulging beyond the passageway 64 (towards the right in FIG. 7), thereby enhancing the stiffness of the contact 22. This supporting engagement limits further deformation of the contact 22 to occur within boundaries of the passageway 64, actuating the spring characteristics of the interior radius sections 48,48'. It would also be possible for the contact 22 to be within the passageway with a pre-loaded deformation, where the central radius 44 and the primary radius sections 46,46' of the resilient portion 36 are initially in a supporting engagement with the module body 24, prior to displacement of the contact surfaces toward each other.

By limiting the lateral deformation of the contact 22 through supporting engagement with the module body 24 the entire contact 22 works to provide sufficient stiffness so that a wiping interconnection between the contact surface 30,32 and the contact pads 16,16*a* occurs as the outward radius sections 50,50' straighten as the circuit members 12,14 are compressed thereupon. The wipe occurs as the effective distance between the supported section of the deformed members 38,40, the primary radii sections 46,46', and the contact surface 32,34 changes as the contact 22 is compressed. It is the optimization of the contact and the constraint of the deformation of the contact 22 that provides sufficient stiffness so that the contact surfaces 30,32 wipe the contact pads 16,16*a* as the contact surfaces 30,32 are displaced towards each other.

It will be appreciated that the present invention has significant advantages for the electrical interconnection of circuit members. It should be recognized that the above-described embodiment constitutes the presently preferred form of the invention and that the invention can take numerous other forms. Accordingly, the invention should be only limited by the scope of the following claims.

We claim:

1. A connector for electrically connecting contact pads of a first circuit member to respective contact pads of a second circuit member, where the circuit members are compressed against the connector, the connector comprising:

a plurality of contact modules each having, a module body with a first end, a second end and a tubular passageway extending therethrough; and a contact having opposing sides, received within the passageway of the module body, having a first contact section extending outward from the first end of the body, a second contact section extending outward from the second end of the body, and a resilient portion having a bow-shape defined by primary radius sections that are convex on the first side and open on the second side, the primary radius sections are separated by a central radius section that is convex on the second side and open on the first side, the resilient portion interconnecting the contact sections and being formed to oppose movement of the contact sections toward each other whereby upon displacement of the contact sections towards each other, the primary radius sections come into supporting engagement with the body along a portion of the passageway, the contact and the module body being interconnected along the central radius section to maintain the contact within the passageway; and a holder having first and second major surfaces and a plurality of openings extending therebetween for individually receiving the contact modules such that the first and second contact sections extend outwardly of the major surfaces and the contact modules are spaced to correspond to the contact pads of the first and second circuit members.

2. The connector of claim 1, wherein the resilient portion includes a first deformed member that includes the first contact section and a second deformed member that includes the second contact section, the deformed members being interconnected and deformed to provide a spring force in response to motion of the contact surfaces towards each other.

3. The connector of claim 2, wherein the resilient portion includes a midpoint where the first deformed member and the second deformed member merge and the second deformed member is a mirror image of the first deformed member about the midpoint.

4. The connector of claim 1, wherein a protrusion extends from the resilient portion of the contact and the body has a lateral cavity in communication with the passageway, the cavity formed to receive the protrusion of the contact, the protrusion captivated within the cavity and being laterally displaceable therealong, whereby the contact is retained within the module body.

5. The connector of claim 1, wherein the module body is formed from a dielectric.

6. The connector of claim 1, wherein the module body is made of an molded plastic.

7. The connector of claim 1, wherein the module body is formed from a conductive material.

8. The connector of claim 1, wherein the module body is die-cast metal.

9. The connector of claim 1, wherein the module body is made of metalized plastic.

10. The connector of claim 1, wherein the holder is formed from a dielectric.

11. The connector of claim 1, wherein the passageways of the holder are conductively interconnected.

12. The connector of claim 1, wherein the module body includes a cylindrical outer surface extending from the second end and a flange extending from the first end to the cylindrical portion, where the cylindrical outer surface is received within the openings of the holder.

13. The connector of claim 12, wherein the contact modules are arranged within the holder so that the flanges of adjacent contact modules correspond to opposite major surfaces of the holder.

14. The connector of claim 4, wherein the further deformation of the first deformed member is independent of further deformation of the second deformed member.

15. The connector of claim 1, wherein the contact sections engage the contact pads in a wiping engagement.

16. The contact of claim 15, wherein the resilient portion has a first deformed portion and a second deformed portion that merge into each other and are mirror images of each other about a midpoint and protrusions extend outward from the contact at the midpoint for engaging the module body and localizing deformation of the deformed sections independent of each other.

17. A deformable, curvilinear contact having opposing sides for insertion into a module body that is retainably positioned by a holder to correspond to respective contact pads of a first circuit member and a second circuit member in order to establish an electrical connection therebetween when the contact pads are compressed against the contact, the contact comprising:

a first contact section for engaging one of the respective contact pads in a wiping interface;

a second contact section for engaging the other respective contact pad in a wiping interface; and a curvilinear resilient portion of varying width interconnecting the sections and having a bow-shape defined by two primary radius sections that are convex on the first side and open on the second side, the primary radius sections are separated by a central radius that is convex on the second side and open on the first side, the primary radius sections engage with the body to prevent the contact from disengaging therefrom and to resiliently oppose movement of the contact sections by becoming supportingly engaged with the module body to provide resistance to assure a wiping interface between the contact pads and the contact sections.

18. The deformable, curvilinear contact of claim 17, wherein the varying width profile of the resilient portion is greater at the primary radius sections and the central radius than therebetween, forming two opposing arrow-head shaped sections.

19. The deformable, curvilinear contact of claim 18, where the two primary radius sections are identically configured.

20. The deformable, curvilinear contact of claim 17, wherein the central radius includes a protrusion extending therefrom for interconnecting the contact to the module body.

21. The contact module of claim 17, wherein the resilient portion has a varying width profile that is greater at the primary radius sections and the central radius than therebetween, whereby opposing arrow-head shaped sections are formed.

22. The deformable, curvilinear contact of claim 21, where the opposing arrow-head shaped sections are symmetrical.

23. A contact module for insertion into an opening of a holder that orientates the contact module to a contact pad of a first circuit member and a corresponding contact pad of a second circuit member for establishing an electrical connection between the respective contact pads when the circuit members are compressed about the contact module and holder, the contact module comprising:

a contact module body having opposing ends and a single tubular passageway therethrough; and a bow-shaped contact having opposing sides, retainably positioned within the passageway of the module body, having a first contact section extending outward from one end of the body and a second contact section extending outward from the other end of the body, and a resilient portion interconnecting the sections and defining the bow-shape by two primary radius sections that are convex on the first side and open on the second side, the primary radius sections having a central radius section therebetween that is convex on the second side and open on the first side, wherein the resilient portion is interconnected with the module body along the passageway to maintain the contact therein, the resilient portion being formed to oppose movement of the contact sections towards each other and, upon displacement of the contact sections towards each other, the primary radius sections deform within the passageway and comes into supporting engagement with the body along a portion of the passageway.

24. A connector for electrically connecting contact pads of a first circuit member to respective contact pads of a second circuit member, where the circuit members are compressed against the connector, the connector comprising:

a plurality of contact modules each having a module body with a first end and a second end and a tubular passageway therethrough that includes a lateral cavity; and a contact, received within the passageway of the module body, having a first contact section extending outward from the first end of the body, a second contact end extending outward from the second end of the body, and a resilient portion having a protrusion extending therefrom and captivated in a laterally displaceable manner within the lateral cavity of the module body being formed to oppose movement of the contact sections towards each other and, upon displacement of the contact sections towards each other, the resilient portion comes into supporting engagement with the body along a portion of the passageway; and a holder having first and second major surfaces and a plurality of openings extending therebetween for individually receiving the contact modules such that the first and second contact sections extend outwardly of the major surfaces and the contact modules are spaced to correspond to the contact pads of the first and second circuit members.

* * * * *